US007950089B2

(12) United States Patent
Kim

(10) Patent No.: US 7,950,089 B2
(45) Date of Patent: May 31, 2011

(54) METHOD OF CONTROLLING WASHING MACHINE AND WASHING MACHINE

(75) Inventor: Nam Chul Kim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 287 days.

(21) Appl. No.: 12/285,510

(22) Filed: Oct. 7, 2008

(65) Prior Publication Data

US 2009/0089938 A1 Apr. 9, 2009

(30) Foreign Application Priority Data

Oct. 8, 2007 (KR) ..... 10-2007-0100928

(51) Int. Cl.
*D06F 39/04* (2006.01)

(52) U.S. Cl. ..... 8/159; 68/15

(58) Field of Classification Search ..... 68/15, 207
See application file for complete search history.

(56) References Cited

U.S. PATENT DOCUMENTS

| | | | | |
|---|---|---|---|---|
| 2,664,094 | A * | 12/1953 | Spragins | 134/58 DL |
| 3,402,576 | A * | 9/1968 | Krupsky | 68/4 |
| 3,935,719 | A * | 2/1976 | Henderson | 68/58 |
| 7,627,920 | B2 * | 12/2009 | Wong et al. | 8/159 |
| 7,690,062 | B2 * | 4/2010 | Pinkowski et al. | 8/158 |
| 7,730,568 | B2 * | 6/2010 | Wong et al. | 8/148 |
| 2006/0101586 | A1 * | 5/2006 | Park et al. | 8/149 |
| 2006/0117596 | A1 * | 6/2006 | Kim et al. | 34/607 |

FOREIGN PATENT DOCUMENTS

| | | | |
|---|---|---|---|
| JP | 02-198595 | * | 8/1990 |
| JP | 05-023493 | * | 2/1993 |

OTHER PUBLICATIONS

Europena Patent Office EP 0 816 550 Jan. 1998.*

* cited by examiner

*Primary Examiner* — Frankie L Stinson
(74) *Attorney, Agent, or Firm* — McKenna Long & Aldridge LLP

(57) ABSTRACT

A method of controlling a washing machine and a washing machine, in which the energy efficiency of a washing machine can be optimized without incurring additional costs are provided. The method includes heating wash water contained in a washing tub; and supplying steam into the washing tub, wherein a time frame during which the heating the wash water is performed at least partially overlaps with a time frame during which the supplying steam is performed. The washing machine includes a cabinet; a washing tub disposed in the cabinet; a wash water heating unit; and a steam supply unit, wherein a time frame during which the wash water heating unit heats the wash water in the washing tub at least partially overlaps with a time frame during which the steam supply unit supplies steam into the washing tub.

14 Claims, 8 Drawing Sheets

METHOD OF CONTROLLING WASHING MACHINE AND WASHING MACHINE

This application claims priority from Korean Patent Application No. 10-2007-0100928 filed on Oct. 8, 2007 in the Korean Intellectual Property Office, the disclosure of which is incorporated herein by reference in its entirety.

BACKGROUND OF THE INVENTION

1. Field of the Invention

The present invention relates to improving the energy efficiency of a washing machine.

2. Description of the Related Art

In general, washing machines are devices for removing dust and dirt from laundry using a chemical dissolution operation involving the use of water and detergent or using a physical operation such as friction between water and the laundry.

Washing machines are classified into a vortex-type washing machine, which includes a washing machine standing upright, generates a vortex in wash water contained in the washing tub, and thus washes laundry using friction between water and laundry, and a drum-type washing machine, which includes a drum and a lifter and washes laundry loaded in the drum using physical impact generated when the laundry is dropped after being lifted up by the lifter upon the rotation of the drum.

The performance of a washing machine is considerably affected by whether detergent is well dissolved in wash water and whether laundry is soaked in wash water to the extent that dust and dirt can be easily separated from the laundry. Thus, in order to improve the washing efficiency of a washing machine, the temperature of wash water may be increased. However, since a considerable amount of thermal energy is generally required to increase the temperature of wash water, it is deemed inefficient to increase the temperature of wash water in terms of power consumption.

In the meantime, in order to improve the thermal efficiency of a washing machine, a heat generator with a high thermal efficiency may be used. However, the introduction of such additional device to an existing washing machine may result in an increase in the price of a washing machine. Therefore, it is necessary to develop ways to improve the thermal efficiency of a washing machine without incurring additional costs.

SUMMARY OF THE INVENTION

The present invention provides a method of controlling a washing machine and a washing machine, in which the energy efficiency of a washing machine can be maximized by minimizing energy consumption using the structure of an existing washing machine.

According to an aspect of the present invention, there is provided a method of controlling a washing machine, the method including heating wash water contained in a washing tub; and supplying steam into the washing tub, wherein a time frame during which the heating the wash water is performed at least partially overlaps with a time frame during which the supplying steam is performed.

According to another aspect of the present invention, there is provided a washing machine including a cabinet; a washing tub which is disposed in the cabinet and contains wash water; a wash water heating unit which heats the wash water in the washing tub; and a steam supply unit which generates steam by heating wash water and supplies the steam into the washing tub, wherein a time frame during which the wash water heating unit heats the wash water in the washing tub at least partially overlaps with a time frame during which the steam supply unit supplies steam into the washing tub.

Therefore, it is possible to reduce energy consumption using the structure of an existing washing machine and thus to improve the energy efficiency of a washing machine.

In addition, it is possible to reduce the time taken to heat wash water to a target temperature and thus to reduce the time taken to wash laundry.

BRIEF DESCRIPTION OF THE DRAWINGS

The above and other features and advantages of the present invention will become more apparent by describing in detail preferred embodiments thereof with reference to the attached drawings in which.

DETAILED DESCRIPTION OF THE INVENTION

A washing machine according to an exemplary embodiment of the present invention will hereinafter be described in detail with reference to FIGS. 1 through 3.

The present invention will hereinafter be described, taking a drum-type washing machine as an example. However, the present invention is not restricted to this. That is, the present invention can also be applied to various washing machines, other than a drum-type washing machine.

Figure 1:
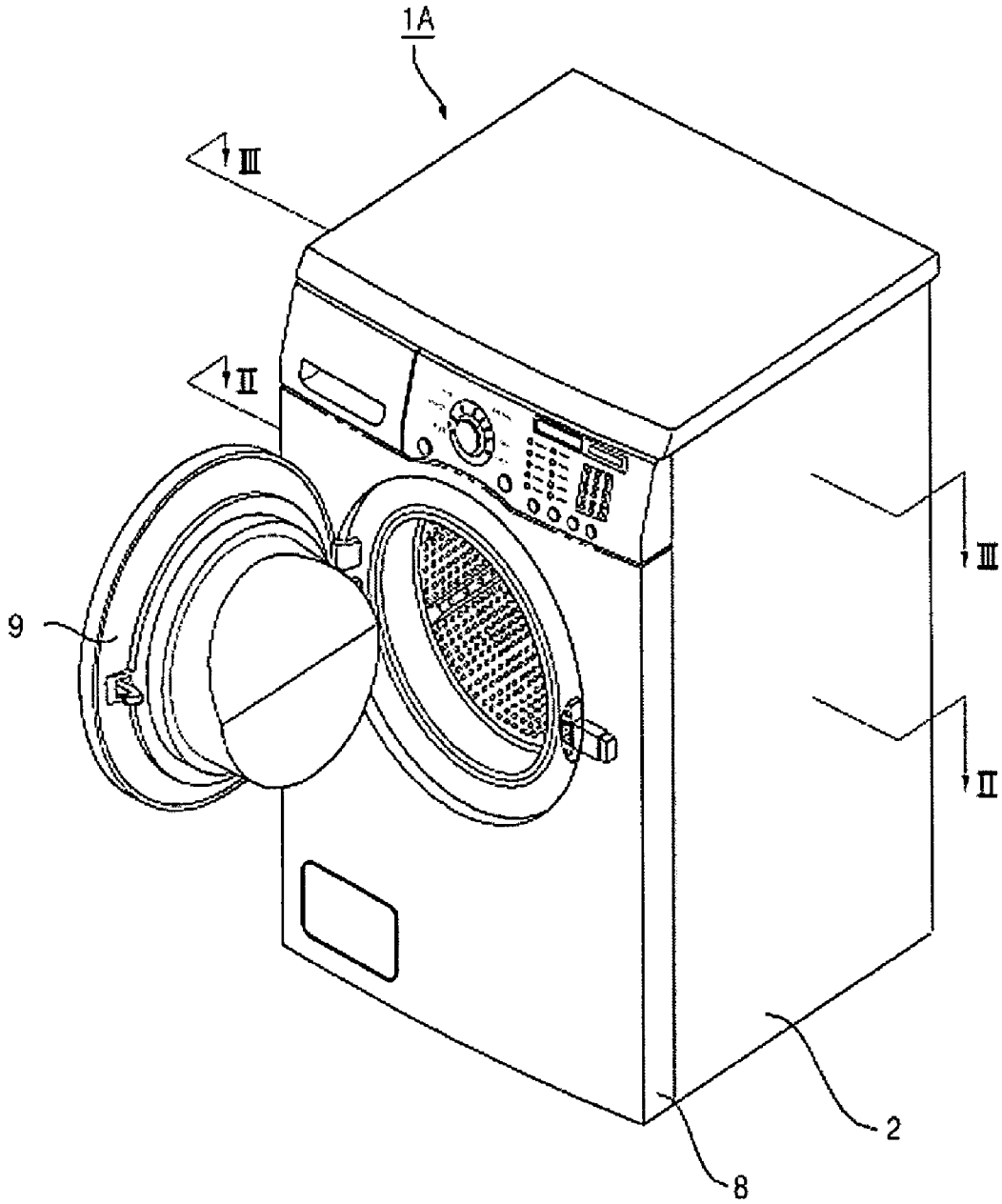
FIG. 1 illustrates a perspective view of a washing machine according to an exemplary embodiment of the present invention.
Figure 2:
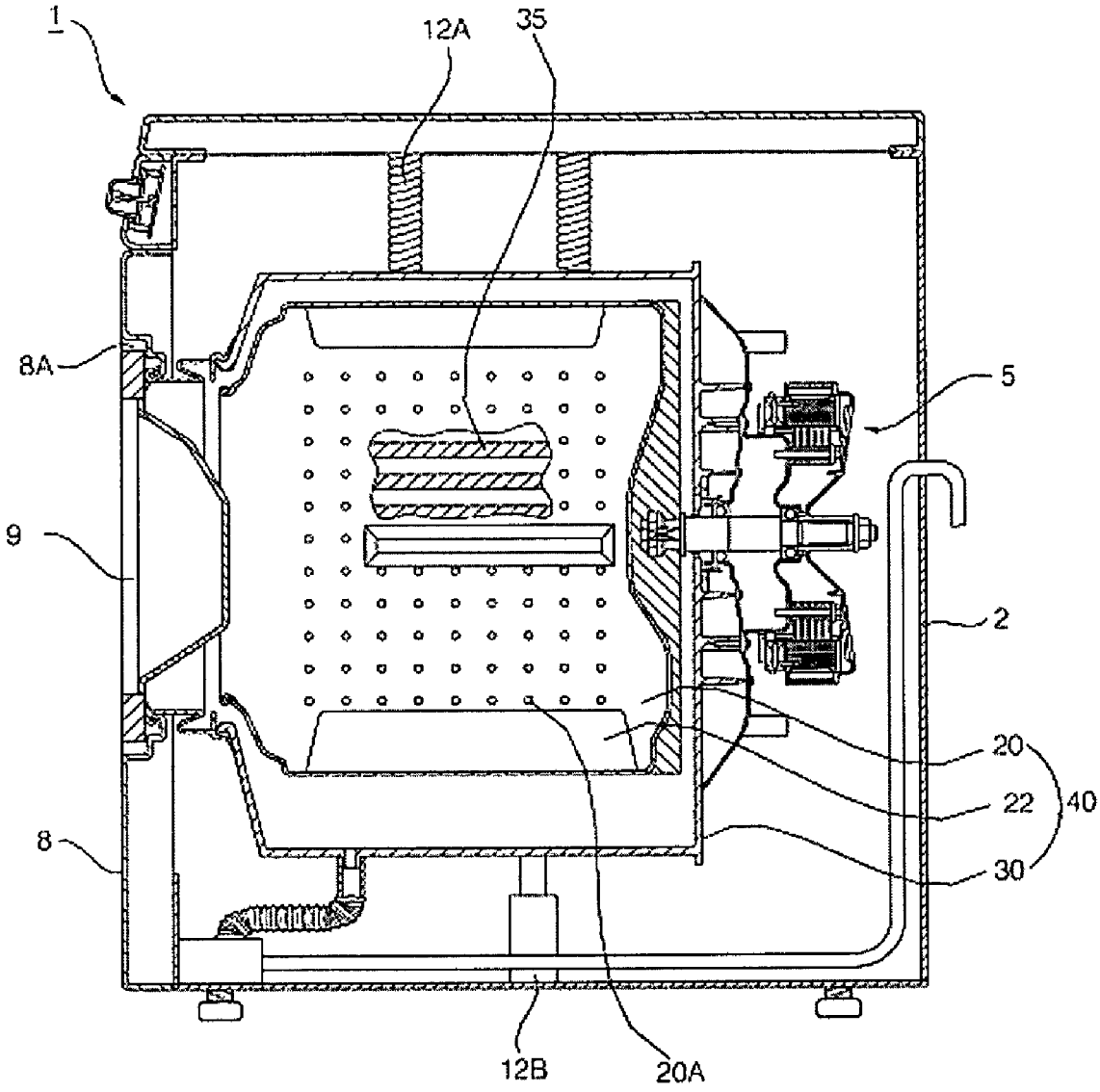
FIG. 2 illustrates a cross-sectional view taken along line II-II of FIG. 1.

Referring to FIGS. 1 and 2, a washing machine 1 includes a cabinet 2, which forms the exterior of the drum-type washing machine 1, a washing tub 40, which is installed in the cabinet 2 and in which laundry is washed, a driving source 5, which is disposed at the rear of the washing tub 40 and provides driving power to the washing tub 40, a cabinet cover 8, which is disposed at the front of the cabinet 2 as part of the cabinet 2 and has a laundry inlet/outlet hole 8A in the middle, a door 9, which is rotatably connected to the cabinet cover 8 so as to open or close the laundry inlet/outlet hole 8A, an external water supply hose 70, which guides wash water supplied by an external water source, a water supply valve 52, which controls wash water supplied through the external water supply hose 70, a detergent supply unit 60, in which wash water supplied through the water supply valve 52 is mixed with detergent, a water supply hose 62, which is provided with wash water mixed with detergent by the detergent supply unit 60 and supplies the wash water into the washing tub 40, a steam supply unit 50 which generates steam by heating wash water supplied through the external water supply hose 70, and a steam nozzle 54, which sprays steam generated by the steam supply unit 50 into the washing tub 40.

The washing tub 40 may include a tub 30, which is installed in the cabinet 2 so as to be buffered by springs 12A and a damper 12B and contains wash water therein, a drum 20, which is installed in the tub 30 so as to be rotated by the driving source 5, contains laundry therein, and has a plurality of through-holes 20A through which wash water can pass, and a lifter 22, which is installed in the drum 20, lifts up laundry to a predefined height and then drops the laundry with the use of gravity.

A heat generation unit for heating wash water contained in the tub 30, and particularly, hotwires 35, may be disposed in the tub 30. When electricity is applied to the hotwires 35, the hotwires 35 generate heat and thus heat the wash water in the tub 30 to a predefined temperature. However, the present invention is not restricted to this. That is, the hotwires 35 may be disposed in the water supply hose 52, through which wash water is supplied. Then, wash water may be heated, and then the heated wash water may be supplied into the washing tub 40.

Figure 3:
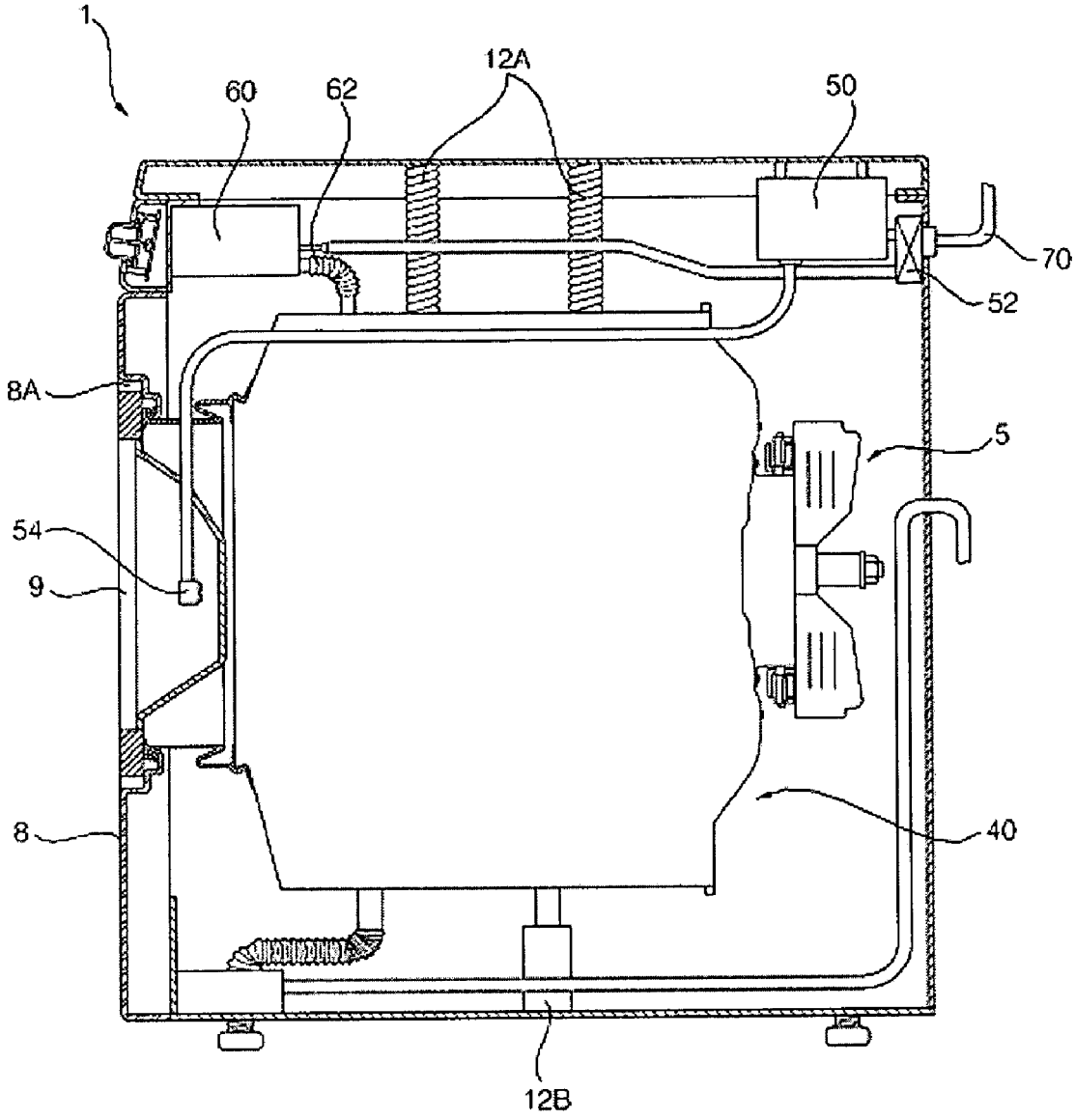
FIG. 3 illustrates a cross-sectional view taken along line III-III of FIG. 1.

The washing tub 40 is illustrated in FIGS. 1 through 3 as including the drum 20 and the tub 30. However, the present invention is not restricted to this. That is, the washing tub 40 may have a different structure from that set forth herein according to the type of the washing machine 1. For example, if the washing machine 1 is a vortex-type washing machine, the washing tub 40 may include a washing drum, which contains laundry, and a rotating vane, which is disposed in the washing drum and generates a vortex in wash water while rotating.

The steam supply unit 50 may evaporate wash water supplied thereinto with the use of hotwires. However, the present invention is not restricted to this. That is, the steam supply unit 50 may generate steam with the use of ultrasonic waves or heat.

A method of controlling the washing machine 1 will hereinafter be described in detail with reference to FIGS. 4 through 6.

Figure 4:
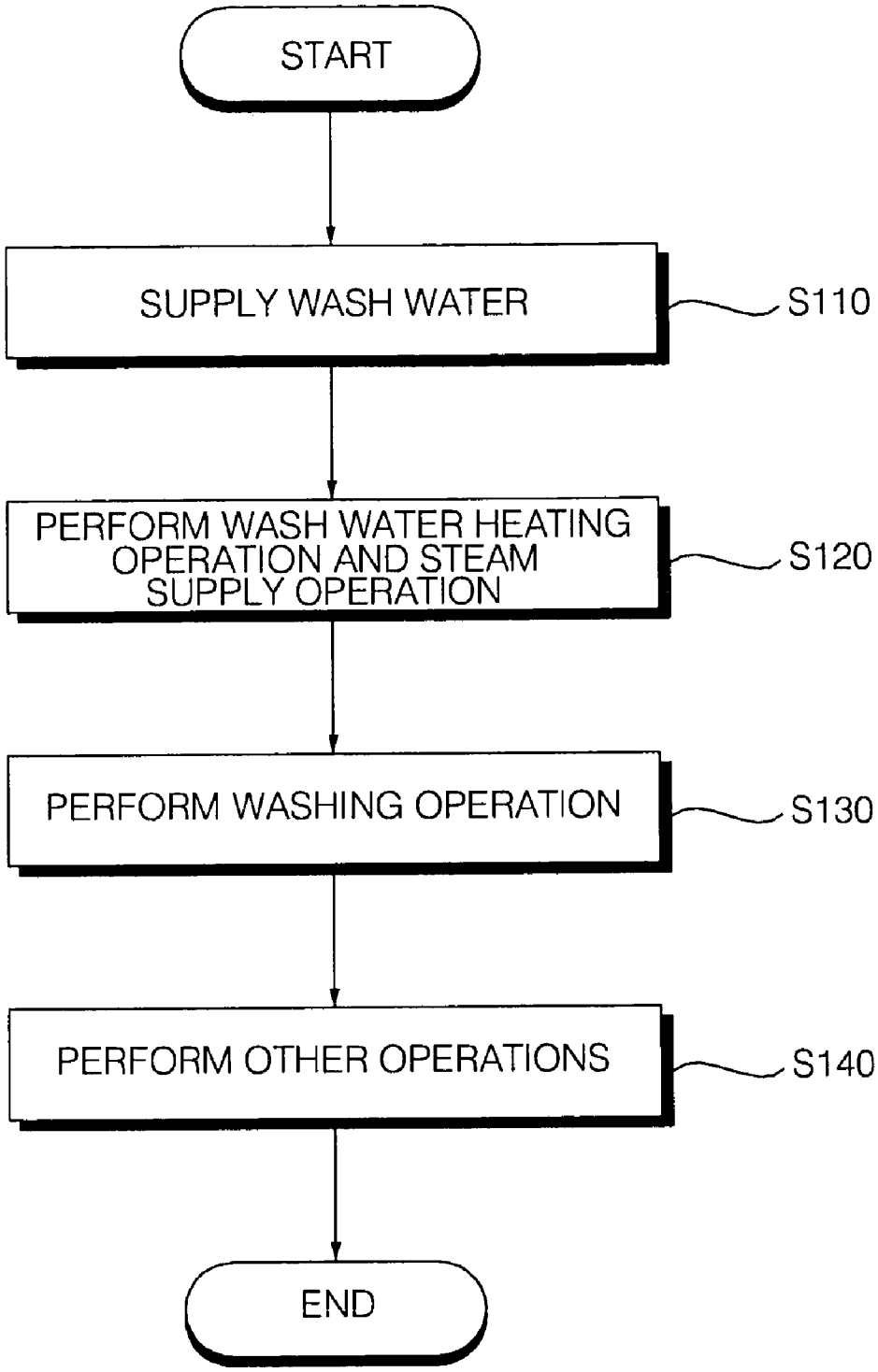
FIG. 4 illustrates a flowchart of a method of controlling a washing machine according to an exemplary embodiment of the present invention.

FIG. 4 illustrates a flowchart of a method of controlling a washing machine according to an exemplary embodiment of the present invention. Referring to FIG. 4, in order to perform a washing operation, wash water is supplied into the washing tub 40 (S110). More specifically, wash water supplied through the external water supply hose 70 may be supplied into the detergent supply unit 60 by opening the water supply valve 72. Thereafter, wash water mixed with detergent by the detergent supply unit 60 may be supplied into the washing tub 60 through the detergent supply unit 60.

Thereafter, the wash water supplied into the washing tub 40 is heated while supplying steam into the washing tub 40 (S120).

Figure 5:
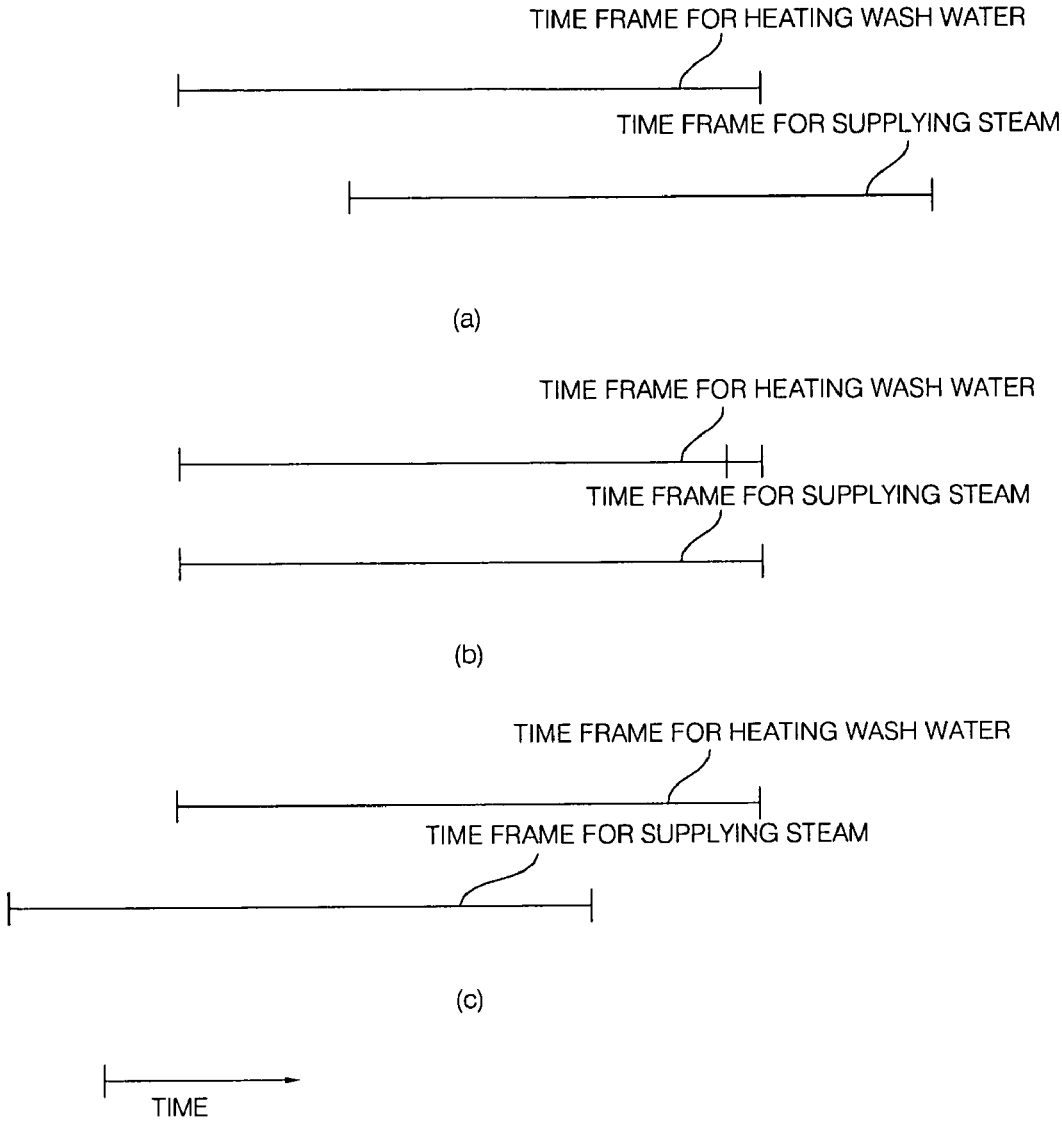
FIG. 5 illustrates diagrams for explaining a time frame during which wash water is heated and a time frame during which steam is supplied.
Figure 6:
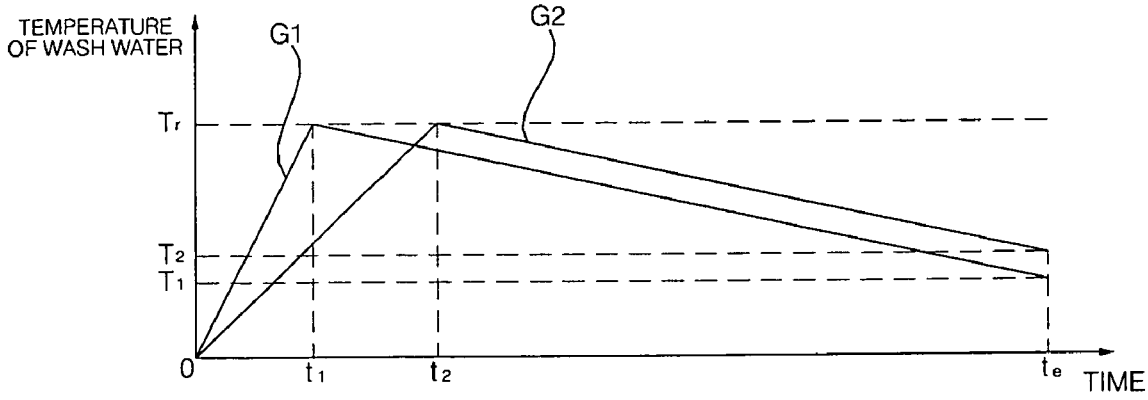
FIG. 6 illustrates a graph for explaining the effects of the method shown in FIG. 4.

Referring to FIG. 5, a time frame for heating the wash water in the washing tub 40 may not necessarily coincide with a time frame for supplying steam into the washing tub 40. That is, the time frame for heating the wash water in the washing tub 40 may only partially overlap with the time frame for supplying steam into the washing tub 40. The heating of the wash water in the washing tub 40 may be performed during the supply of steam into the washing tub 40. Alternatively, the supply of steam into the washing tub 40 may be performed during the heating of the wash water in the washing tub 40.

More specifically, referring to FIG. 5(*a*), the time frame for heating the wash water in the washing tub 40 may begin and end earlier than the time frame for supplying steam into the washing tub 40. That is, the heating of the wash water in the washing tub 40 may begin. During the heating of the wash water in the washing tub 40, steam may be supplied into the washing tub 40 so that the wash water in the washing tub 40 can be further heated by the steam. Therefore, it is possible to quickly heat the wash water in the washing tub 40 to a target temperature. In addition, since the time frame for supplying steam into the washing tub 40 does not end but continues after the end of the time frame for heating the wash water in the washing tub 40, it is possible to reduce the power consumption of the dishwasher 1.

Referring to FIG. 5(*b*), the time frame for heating the wash water in the washing tub 40 may coincide with the time frame for supplying steam into the washing tub 40. That is, the heating of the wash water in the washing tub 40 and the supply of steam into the washing tub 40 may be performed at the same time. Thus, it is possible to reduce the amount of energy required to heat the wash water in the washing tub 40.

Referring to FIG. 5(*c*), the time frame for supplying steam into the washing tub 40 may begin and end earlier than the time frame for heating the wash water in the washing tub 40. When wash water supplied by an external water source is contained in the washing tub 40, the wash water in the washing tub 40 is preheated by supplying steam into the washing tub 40. The preheated wash water is further heated to an optimum temperature for performing a washing operation during the time frame for heating the wash water in the washing tub 40. Since the wash water in the washing tub 40 is preheated by steam supplied into the washing tub 40, it is possible to reduce the time frame for heating the wash water in the washing tub 40 and thus to reduce the power consumption of the washing machine 1.

The heating of the wash water in the washing tub 40 may be performed by the hotwires 35 in the tub 30, but the present invention is not restricted to this. The supply of steam into the washing tub 40 may be performed by evaporating wash water supplied into the steam supply unit 50 and spraying the evaporated wash water into the washing tub 40 through the steam nozzle 54.

In short, the heating of the wash water in the washing tub 40 and the supply of steam into the washing tub 40 may be performed at the same time. Thus, it is possible to quickly heat the wash water in the washing tub 40 to a target temperature. However, the time frame for heating the wash water in the washing tub 40 not necessarily coincide with the time frame for supplying steam into the washing tub 40.

Referring to FIG. 4, a washing operation is performed by rotating the drum 20 (S130). Thereafter, subsequent operations such as a drain operation for discharging waste wash water, a rinsing operation for rinsing laundry, and a dehydration operation for dehydrating laundry may be performed (S140). Thereafter, the method ends.

The effects of the method shown in FIG. 4 will hereinafter be described in detail with reference to FIG. 6. FIG. 6 illustrates graphs G1 and G2 each showing the variation of the temperature of wash water in a washing tub over a time period between the heating of the wash water in the washing tub to a target temperature $T_r$ and the discharge of wash water from the washing tub. Referring to FIG. 6, the graph G1 corresponds to a washing machine (hereinafter referred to as the washing machine G1) in which the heating of wash water in the washing tub and the supply of steam into the washing tub are performed at the same time, and the graph G2 corresponds to a washing machine (hereinafter referred to as the washing machine G2) in which the heating of wash water in the washing tub and the supply of steam into the washing tub are not performed at the same time.

Referring to 6, the temperature of wash water heated by the washing machine G1 gradually increases and reaches the target temperature $T_r$ at $t_1$. On the other hand, the temperature of wash water heated by the washing machine G2 reaches the target temperature $T_r$ at $t_2$, which is later than the time $t_1$. In the case of the washing machine G1, steam generated by a steam supply unit is sprayed onto laundry during the heating of wash water by hotwires in a washing tub. Thus, the amount of thermal energy supplied into the washing tub of the washing machine G1 is greater than the amount of thermal energy supplied into the washing tub of the washing machine G2. During a time period from 0 to $t_e$, a washing operation is performed, and then wash water used in the washing operation is discharged. The higher the temperature of wash water during a drain operation, the more the amount of thermal energy wasted. Since the composition of wash water is uniform, the rate at which the temperature of wash water decreases over time is also uniform. Thus, the temperature of wash water in the washing machine G2 at $t_e$ is higher than the temperature of wash water in the washing machine G1 at $t_e$. Therefore, it is determined that the amount of thermal energy wasted by the washing machine G2 is greater than the amount of thermal energy wasted by the washing machine g1. In short, the longer the time taken to heat wash water to the target temperature $T_r$, the more the amount of thermal energy wasted. Accordingly, it is concluded that the thermal efficiency of the washing machine G1 is higher than the thermal efficiency of the washing machine G2.

The time taken to heat wash water to a target temperature may be reduced by increasing the thermal capacity of a heat supply unit of a washing machine. In this case, however, additional costs may be incurred, and the size of the heat supply unit may need to be increased. On the other hand, according to the present invention, it is possible to quickly heat wash water to a target temperature by using existing elements of a washing machine such as a steam supply unit and a heat supply unit without the need to increase the capacity of a washing machine or to install additional devices. Thus, it is possible to reduce the thermal energy consumption of a washing machine simply by modifying the program of a micom in the washing machine. Therefore, it is possible to improve the cost-effectiveness and the performance of a washing machine.

A method of controlling a washing machine according to another exemplary embodiment of the present invention will hereinafter be described in detail with reference to FIG. 7.

Figure 7:
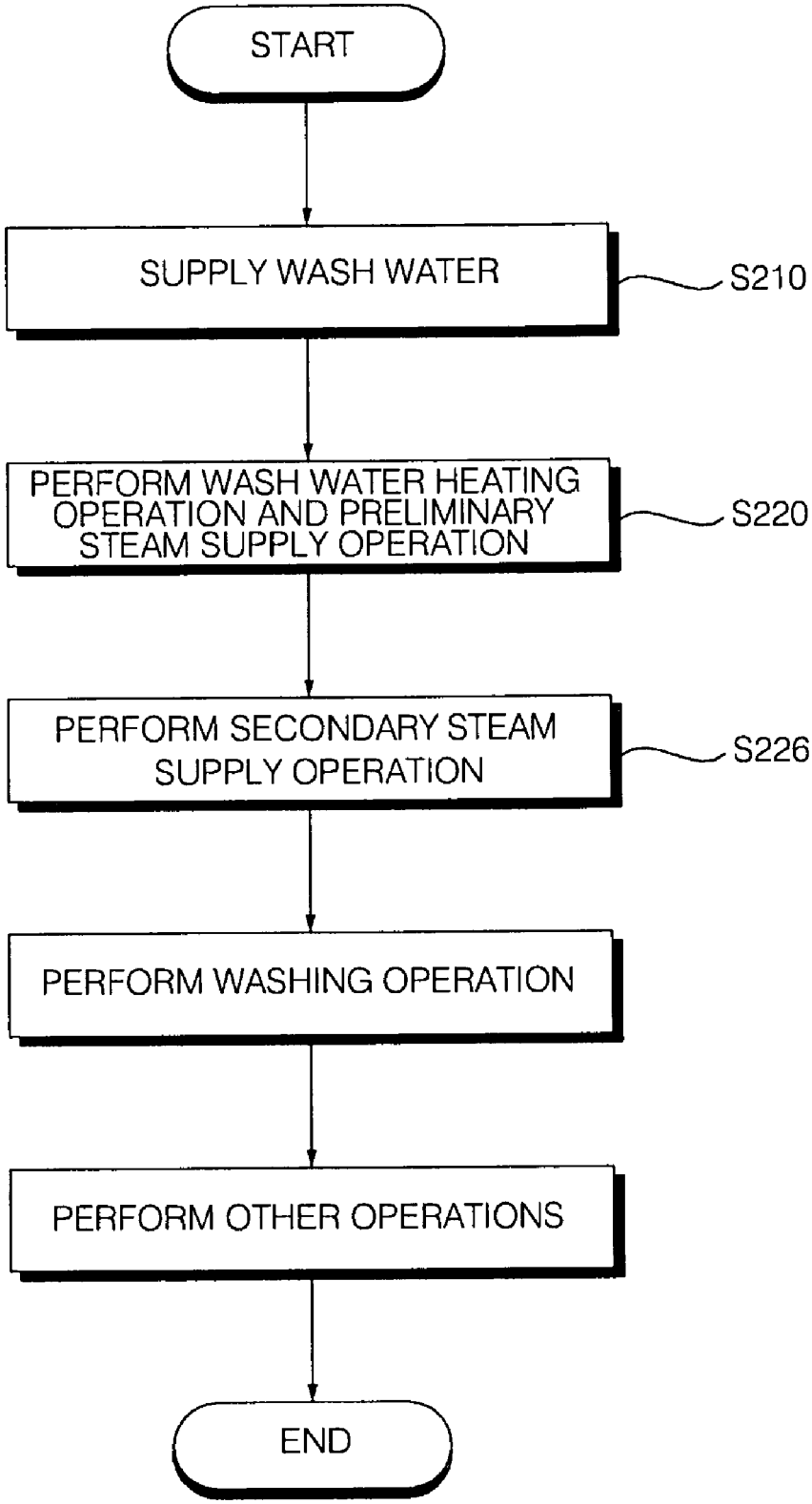
FIG. 7 illustrates a flowchart of a method of controlling a washing machine according to another exemplary embodiment of the present invention.

The exemplary embodiment of FIG. 7 is substantially the same as the exemplary embodiment of FIG. 4 except that the supply of steam into the washing tub 40 is performed over two stages. Therefore, the exemplary embodiment of FIG. 7 will hereinafter be described, mainly focusing on differences with the exemplary embodiment of FIG. 4.

Referring to FIG. 7, wash water is supplied into the washing tub 40 (S210). Thereafter, the wash water in the washing tub 40 is heated while preliminarily supplying steam into the washing tub 40 (S220). As a result, the wash water in the washing tub 40 is heated to a target temperature. Thereafter, steam is secondarily supplied into the washing tub 40 (S224). Thus, even if the target temperature is slightly lower than an optimum temperature for washing laundry, dust and dirt can be effectively removed from laundry by directly spraying steam onto the laundry. Therefore, it is possible to obtain the benefits of heating the wash water in the washing tub 40 to the optimum temperature for washing laundry while consuming less thermal energy. In addition, it is possible to improve the thermal efficiency of the washing machine 1.

Figure 8:
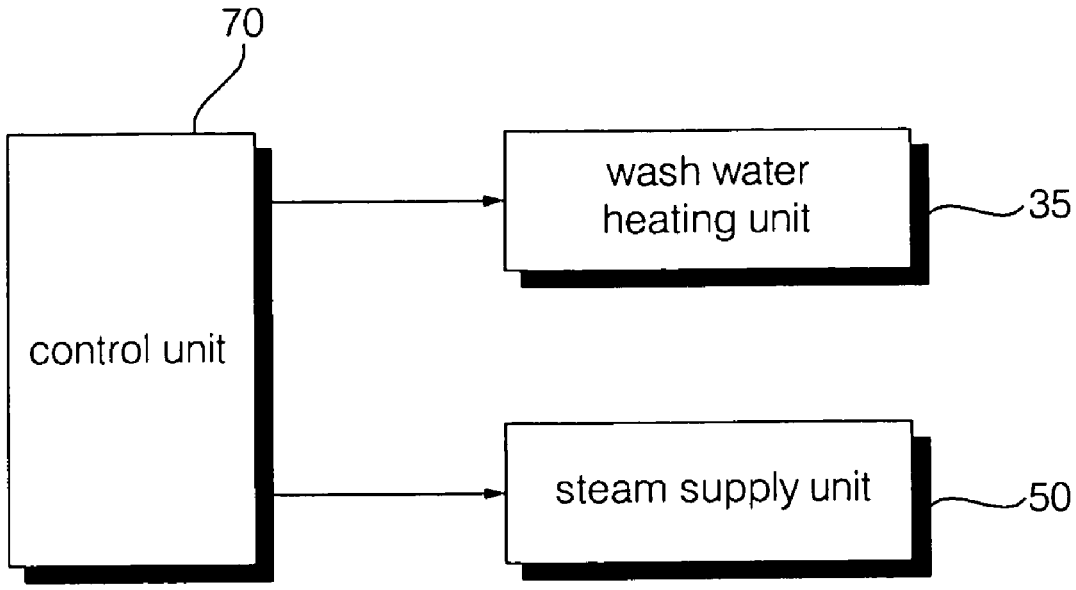
FIG. 8 illustrates a block diagram of the washing machine shown in FIG. 1.

Referring to FIG. 8, the washing machine 1 may also include a wash water heating unit 35, which heats wash water, the steam supply unit 50, which generates steam by evaporating wash water and supplies the steam into the washing tub 40, and a control unit 70, which controls the operations of the wash water heating unit 35 and the steam supply unit 50. When the washing machine 1 begins to operate, wash water is supplied into the washing tub 40. Then, the control unit 70 applies power to the wash water heating unit 35 in order to heat the wash water in the washing tub 40. The wash water heating unit 35 begins to operate by being powered by the control unit 70 and thus increases the temperature of the wash water in the washing tub 40. During the heating of the wash water in the washing tub 40 by the wash water heating unit 35, the steam supply unit 50 begins to operate and supplies steam into the washing tub 40. Thus, it is possible to reduce the time taken to heat the wash water in the washing tub 40 to a target temperature. Therefore, it is possible to reduce the power consumption of the wash water heating unit 35.

A time frame during which the wash water heating unit 35 heats the wash water in the washing tub 40 may at least partially overlap with a time frame during which the steam supply unit 50 supplies steam into the washing tub 40. That is, the steam supply unit 50 may begin to supply steam into the washing tub 40 a predefined amount of time after the wash water heating unit 35 begins to heat the wash water in the washing tub 40. Alternatively, the heating of the wash water in the washing tub 40 by the wash water heating unit 35 and the supply of steam into the washing tub 40 by the steam supply unit 50 may be performed at the same time. Still alternatively, the wash water heating unit 35 may begin to heat the wash water in the washing tub 40 a predefined amount of time after the steam supply unit 50 begins to supply steam into the washing tub 40. In short, the heating of the wash water in the washing tub 40 by the wash water heating unit 35 may be facilitated by supplying steam into the washing tub 40 with the use of the steam supply unit 50. Therefore, it is possible to reduce the power consumption of the wash water heating unit 35.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A method of controlling a washing machine, the method comprising:

heating wash water contained in a washing tub during a first time frame having a first duration; and supplying steam into the washing tub during a second time frame having a second duration, wherein at least a portion of the first time frame occurs simultaneously with at least a portion of the second time frame, wherein a first supply of steam into the washing tub occurs during heating the wash water and a second supply of steam into the washing tub occurs after heating the wash water.

2. The method of claim 1, wherein the first time frame begins and ends during the second time frame.

3. The method of claim 1, further comprising supplying wash water into the washing tub, wherein the first time frame and the second time frame begin after the supplying wash water.

4. The method of claim 1, wherein the heating the wash water comprises heating the wash water in the washing tub by using heat generated by a heat generation unit included in the washing tub.

5. The method of claim 1, wherein the heating comprises heating the wash water in the washing tub by using steam generated by a steam supply unit.

6. The method of claim 1, wherein the first time frame ends a predetermined amount of time before the second time frame ends.

7. The method of claim 1, wherein the first duration and the second duration are equal and both time frames begin simultaneously.

8. The method of claim 1, wherein the first time frame begins a predetermined amount of time after second time frame begins.

9. The method of claim 1, wherein the first time frame ends a predetermined amount of time after the second time frame ends.

10. A washing machine comprising:

a cabinet;

a washing tub, which is disposed in the cabinet and contains wash water;

a wash water heating unit, which heats the wash water in the washing tub; and a steam supply unit, which:

generates steam by heating wash water; and supplies the generated steam into the washing tub, wherein a first time frame during which the wash water heating unit heats the wash water in the washing tub at least partially overlaps with a second time frame during which the steam supply unit supplies steam into the washing tub, wherein the second time frame begins no later than the first time frame begins.

11. The washing machine of claim 10, wherein the wash water heating unit heats the wash water in the washing tub during the supply of steam into the washing tub by the steam supply unit.

12. The washing machine of claim 10, wherein a first supply of steam from the steam supply unit into the washing tub occurs during the heating the wash water and a second supply of steam from the steam supply unit into the washing tub occurs after the heating of the wash water in the washing tub by the wash water heating unit.

13. The washing machine of claim 10, wherein the steam supply unit supplies steam into the washing tub during the heating of the wash water in the washing tub by the wash water heating unit.

14. The washing machine of claim 10, wherein the heating of the wash water in the washing tub by the wash water heating unit and the supply of steam into the washing tub by the steam supply unit are performed at the same time.

* * * * *